United States Patent [19]

Matthews

[11] Patent Number: 4,854,899

[45] Date of Patent: Aug. 8, 1989

[54] TERMINAL BUS JUNCTION WITH MULTIPLE, DISPLACED CONTACT POINTS

[75] Inventor: Russell H. Matthews, Modesto, Calif.

[73] Assignee: Elcon Products International Company, Fremont, Calif.

[21] Appl. No.: 124,920

[22] Filed: Nov. 24, 1987

[51] Int. Cl.[4] ..... H01R 4/48

[52] U.S. Cl. ..... 439/724; 439/856

[58] Field of Search ..... 439/709, 712, 715, 716, 439/721, 723, 724, 843, 847, 851, 852, 853, 856, 862

[56] References Cited

U.S. PATENT DOCUMENTS

| | | | |
|---|---|---|---|
| 3,383,643 | 5/1968 | Nava et al. | 439/724 |
| 3,560,911 | 2/1971 | Zimmerman, Jr. et al. | 439/723 X |
| 4,653,842 | 3/1987 | Kirma | 439/712 |

*Primary Examiner*—Paul Gensler

*Attorney, Agent, or Firm*—Flehr, Hohbach, Test, Albritton & Herbert

[57] ABSTRACT

A modular connector (40) has a polyester housing (42) with a rubber grommet (43) through which pins (12) crimped to wires (48) pass to plug into sockets (46). The housing (42) has an array (50) of receptacles (52) for the sockets (46). The sockets (46) have a cylindrical beryllium copper alloy body )54) with cantilever spring elements (56) positioned at 180 degrees with respect to each other on the body (54). The body (54) has a distal end (60) with three fingers (62) extending from the distal end (60). The three fingers (62) are positioned on the body (54) at 120 degrees with respect to one another and so that they are radially displaced with respect to the cantilever spring elements (56). The fingers (62) incline from the distal end (60) of the body (54) so that the tips (64) are contiguous to axis (66) of the body (54) when pins (12) are not plugged into the sockets (46). Body (54) of each socket (46) engages a common bus element (70). An enclosed chamber (72) between top (45) and bottom (47) of the housing (42) receives the bus element (70). The top (45) and bottom (47) are ultrasonically bonded together to form the enclosed chamber (42).

13 Claims, 7 Drawing Sheets

70
72

10
90
88

10
84
86
82
94

TERMINAL BUS JUNCTION WITH MULTIPLE, DISPLACED CONTACT POINTS

BACKGROUND OF THE INVENTION

1. Field of the Invention

This invention relates to an improved form of a modular connector for providing an internal bussing system especially adapted for high reliability avionics and ground vehicle applications. More particularly, it relates to such a modular connector incorporating an improved electrical contact structure, which provides a multiplicity of contact points between conductive elements making up the contact structure and in which the multiplicity of contact points are radially displaced from one another around the conductive elements.

2. Description of the Prior Art

Modular connectors which provide an internal bussing system for high reliability avionics, ground vehicle and similar applications are known in the art. For example, such modular connectors are commercially available from Elcon Products International Company under the designation Terminal Bus Junction (TBJ). In the configuration of these modular connectors, a number of pin contacts each crimped on the end of electrical wires engage a like number of socket contacts and retention members in an environmentally sealed housing. In these commercially available modular connectors, the socket contacts have cantilever spring portions which engage a relatively larger diameter base portion of each pin contact and a relatively smaller diameter distal portion of the pin contact. These cantilever spring portions are positioned in base and distal pairs at 180 degrees with respect to one another, with each base and distal pair at the same radial position around the contacts, but spaced along an axial direction of the socket from each other. The configuration of these spring portions only provides contact wipe in a single axis, and the sockets must be plated both before and after forming as a result of their configuration. While these connectors have proved to be highly reliable and meet or exceed stringent MIL-STD-202 and MIL-STD-1344 requirements, including vibration, altitude immersion, salt spray, fluid resistance and thermal shock, it would be advantageous to enhance the performance of these connectors, while maintaining their standard form factor.

Another example of a commercially available connector of this general type is supplied by Burndy Corporation, Norwalk, Conn. 06856 under the designation YHLZ Modular Terminal Block System. These connectors require a special pin contact and removal tool and have separate socket and retention structures. Additional prior art connectors are disclosed in the following issued U.S. Pat. Nos. and published application: U.S. Pat. No. 3,375,481, issued Mar. 26, 1968 to Parnell; U.S. Pat. No. 3,456,231, issued Jul. 15, 1969 to Paullus et al.; U.S. Pat. No. 3,471,822, issued Oct. 7, 1969 to Van Baelen; U.S. Pat. No. 3,597,726, issued Aug. 3, 1971 to Appleton; U.S. Pat. No. 3,835,442, issued Sept. 10, 1974 to Anderson et al.; U.S. Pat. No. 4,090,764, issued May 23, 1978 to Malsby et al.; West German Published Application No. 2,158,187, published Nov. 24, 1971. The above comments with respect to contact point orientation in the Elcon commercial product also apply to these other prior art connectors.

SUMMARY OF THE INVENTION

Accordingly, it is an object of this invention to provide a modular connector suitable for providing an internal bussing system for high reliability avionics, ground vehicle and similar applications and which has an increased current carrying capability, while adhering to a standard form factor for such connectors.

It is another object of the invention to provide such a modular connector in which contact points in a socket of the connector for base and distal portions of a contact pin engaging the socket are radially displaced with respect to each other.

It is a further object of the invention to provide such a modular connector having an increased insensitivity to vibration and shock.

It is still another object of the invention to provide such a modular connector having an increased number of contact points between conductive elements in the modular connector.

It is yet another object of the invention to provide such a modular connector in which contact wipe is obtained in two dimensions when conductive elements in the modular connector are plugged together.

It is a still further object of the invention to provide such a modular connector in which contact fingers of a socket in the connector can be plated in a single step after the socket is formed.

It is another object of the invention to provide such a modular connector which accepts standard pin contacts.

It is still another object of the invention to provide such a modular connector which allows use of a standard contact pin insertion and removal tool.

It is a further object of the invention to provide such a modular connector which eliminates the use of potting compounds for insuring isolation of bus elements in the connector.

These and related objects may be achieved through use of the novel modular connector herein disclosed. A connector in accordance with the invention has a housing with at least one socket receptacle in the housing. A conductive socket is positioned in the socket receptacle. The conductive socket has a generally cylindrical wall with at least one cantilever spring contact element extending inward from the generally cylindrical wall into the conductive socket. A plurality of contact fingers extend from a distal end of the generally cylindrical wall at an angle toward a longitudinal axis of the generally cylindrical wall. The at least one cantilever spring contact element and the plurality of contact fingers are radially displaced with respect to one another. A connector having a socket with this configuration has an increased current carrying capability.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
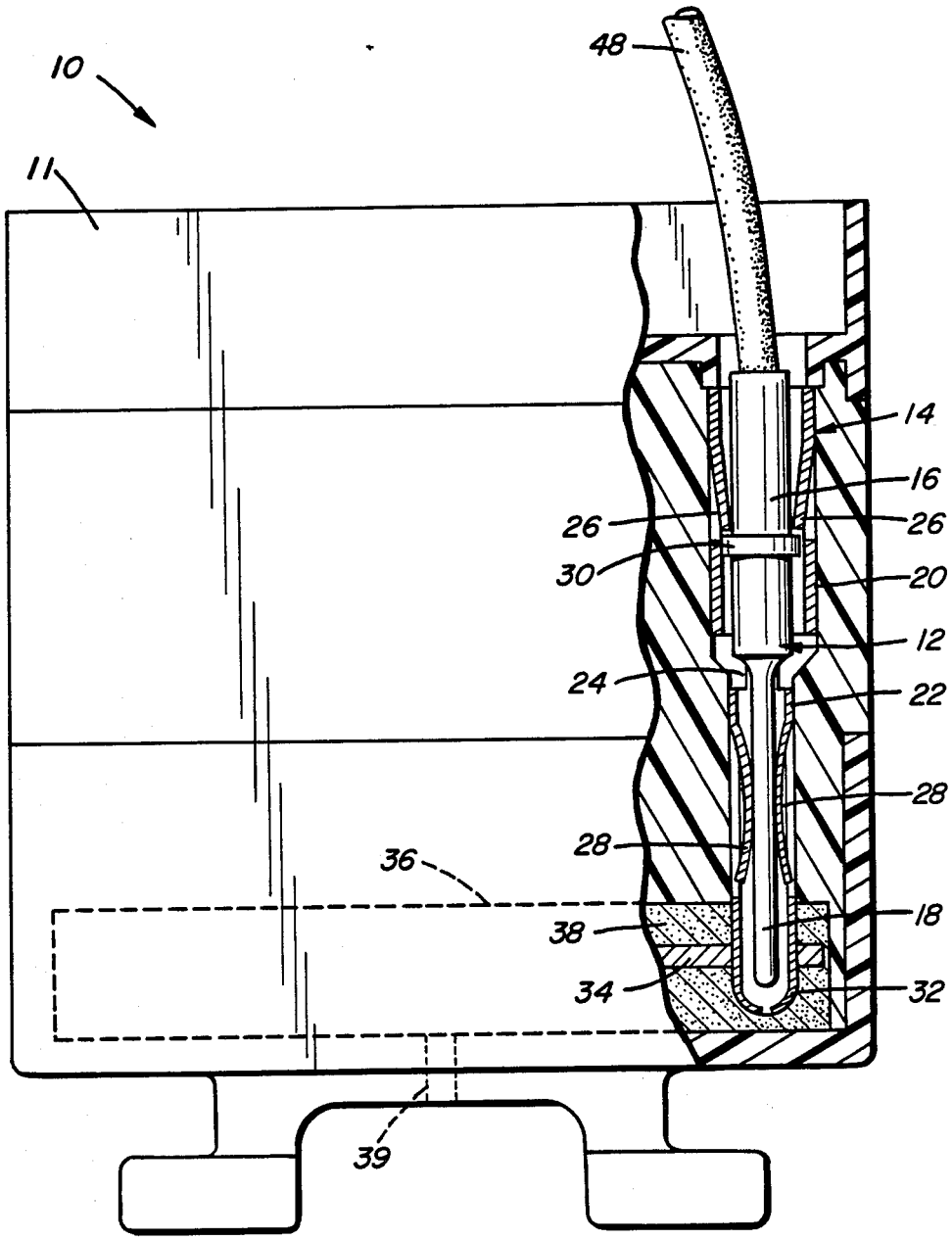
FIG. 1. (PRIOR ART)
FIG. 1 is a front view of a prior art modular connector, with a partial cross-section taken along the line 1—1 in FIG. 2.
Figure 2A:
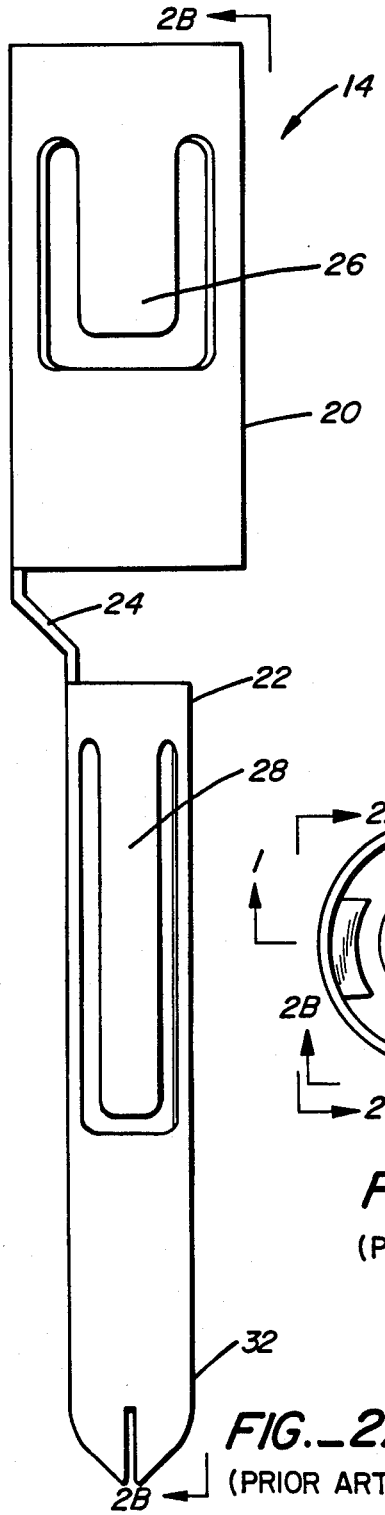
FIG. 2A. (PRIOR ART)
FIG. 2A is a side view of the modular connector portion of FIG. 2, shown from the position indicated by the line 2A—2A in FIG. 2.
Figure 2:
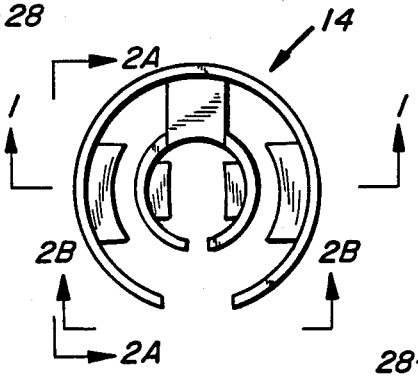
FIG. 2. (PRIOR ART)
FIG. 2 is an end view of a portion of the prior art modular connector of FIG. 1.
Figure 2B:
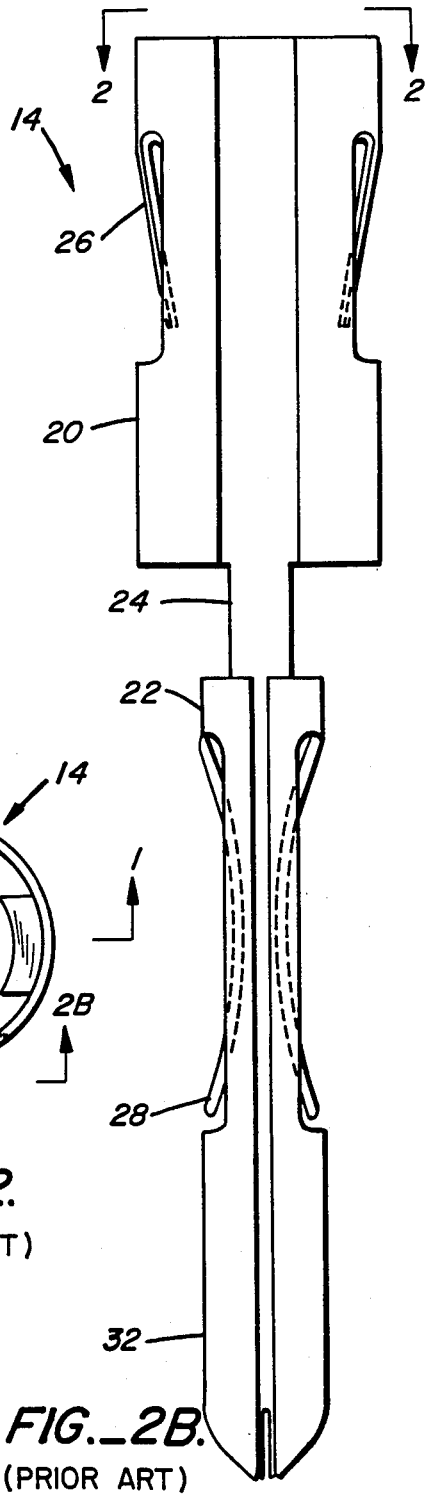
FIG. 2B. (PRIOR ART)
FIG. 2B is another side view of the modular connector portion of FIG. 2, shown from the position indicated by the line 2B—2B in FIG. 2.
Figure 3:
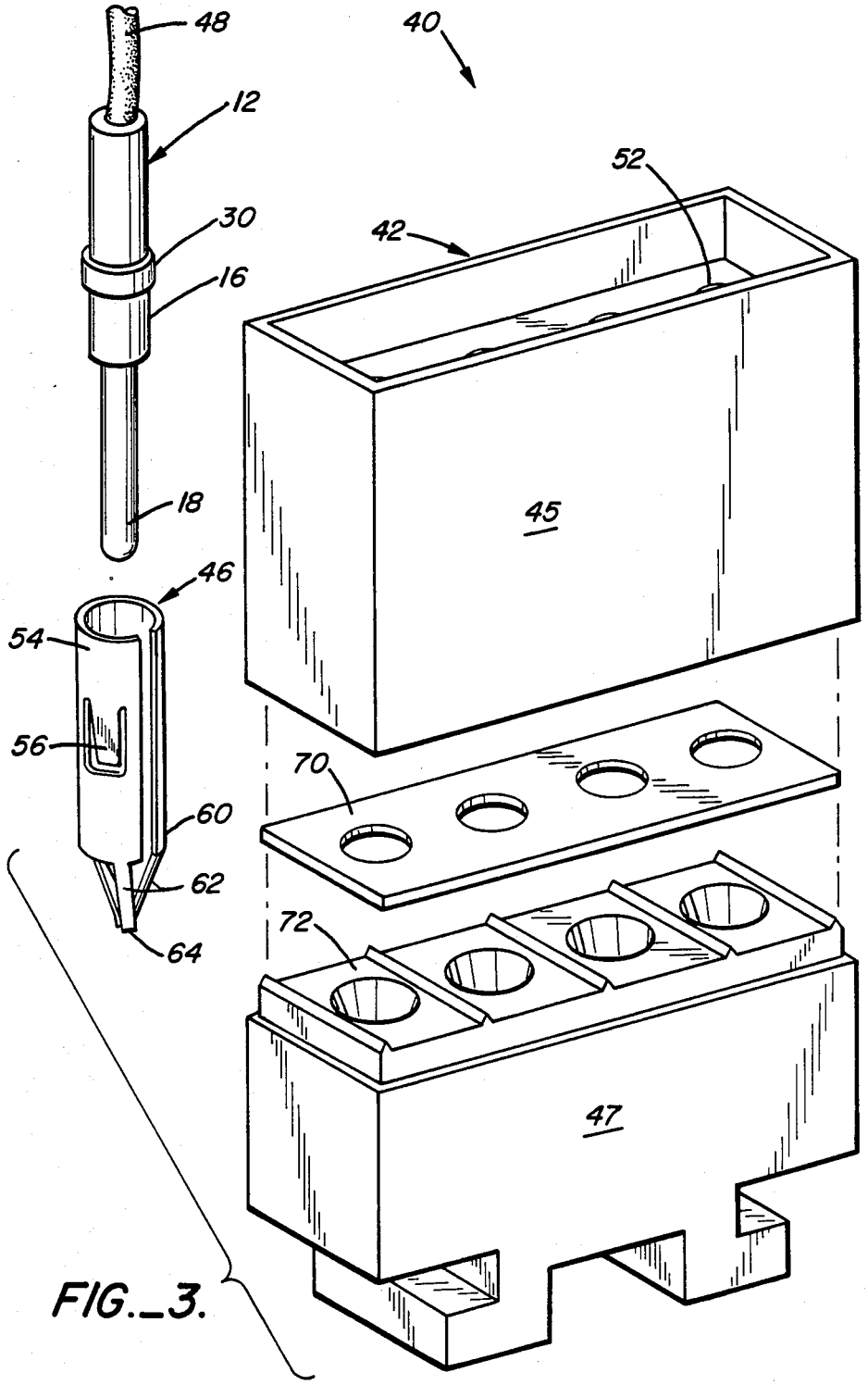
FIG. 3 is an exploded perspective view of a modular connector in accordance with the invention.

Turning now to the drawings, more particularly to FIGS. 1–2B, there is shown a prior art Elcon TBJ type modular connector 10. The connector 10 includes a housing 11 and an array inside the housing 11 of industry standard MIL-C-39029/4 pins 12 and sockets 14 into which the pins 12 fit to make electrical contact. Each pin 12 includes a base portion 16 and a distal portion 18. Each socket 14 has a base portion 20 joined to a distal portion 22 by an angled strip 24. The base portion 20 of the socket 14 has a pair of cantilever spring elements 26 and the distal portion 22 has a similar pair of cantilever spring elements 28. As is best shown in FIGS. 2–2B, the pairs of elements 26 and 28 are spaced apart on the base and distal portions 20 and 22, respectively, at 180 degrees with respect to each other. However, the corresponding elements 26 and 28 are located at the same radial position and spaced along the length of the socket 14. The pin 12 plugs into the socket 14 so that base portion 16 engages the cantilever spring elements 26 and distal portion 18 engages the cantilever spring elements 28. Ring 30 on the base portion 16 of the pin 12 snaps into place behind the elements 26 to lock the pin 12 into the socket 14. The distal portion 22 of each socket 14 is connected at its tip 32 into a common bus element 34 in enclosure 36 at the bottom of the housing 11. An epoxy or other suitable potting compound 38 is introduced into the enclosure 36 through an opening 39 in the housing to ensure electrical isolation of the common bus element 34.

Figure 4:
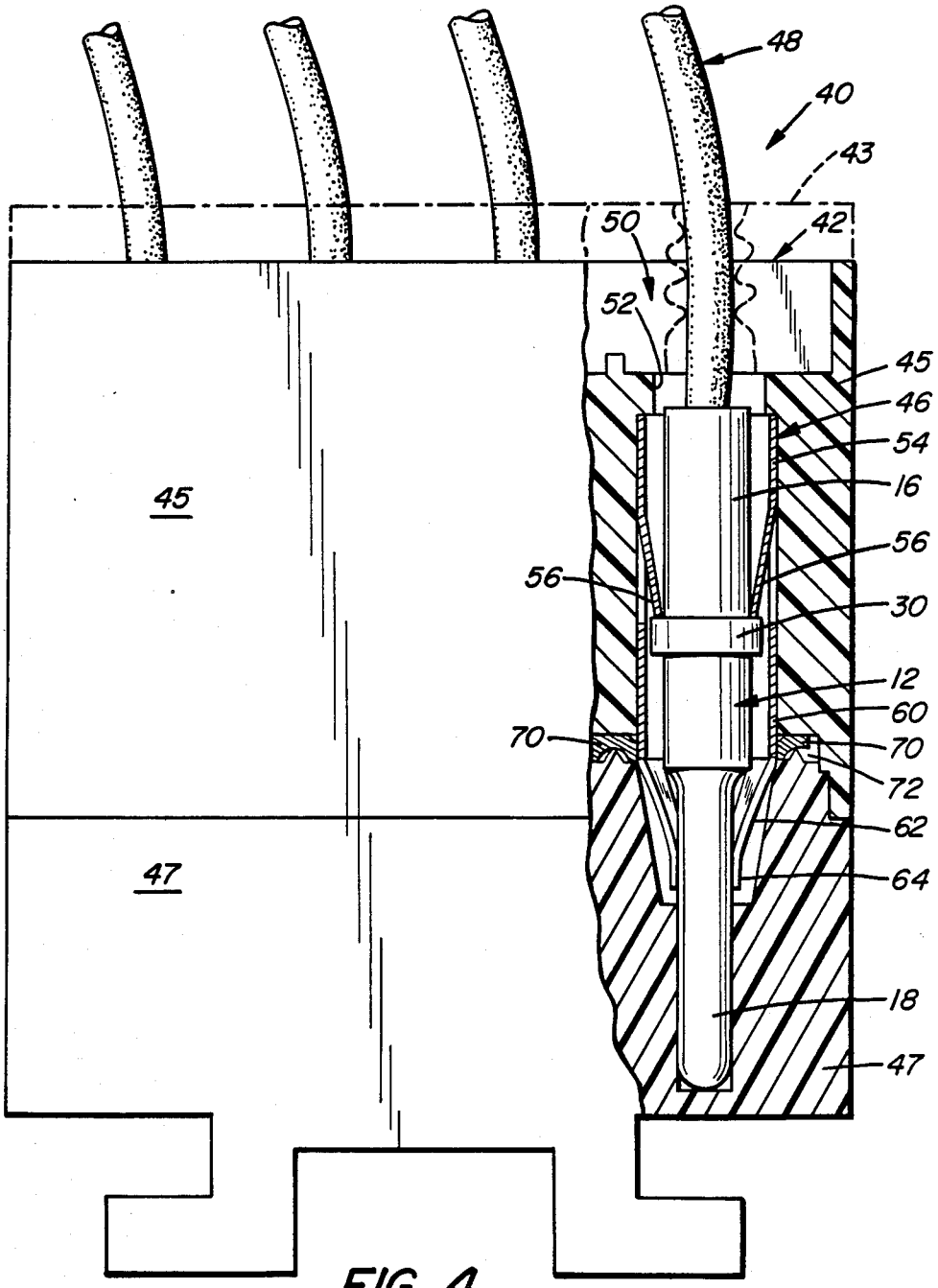
FIG. 4 is a front view with a partial cross-section of the modular connector of FIG. 3 in assembled form.
Figure 5:
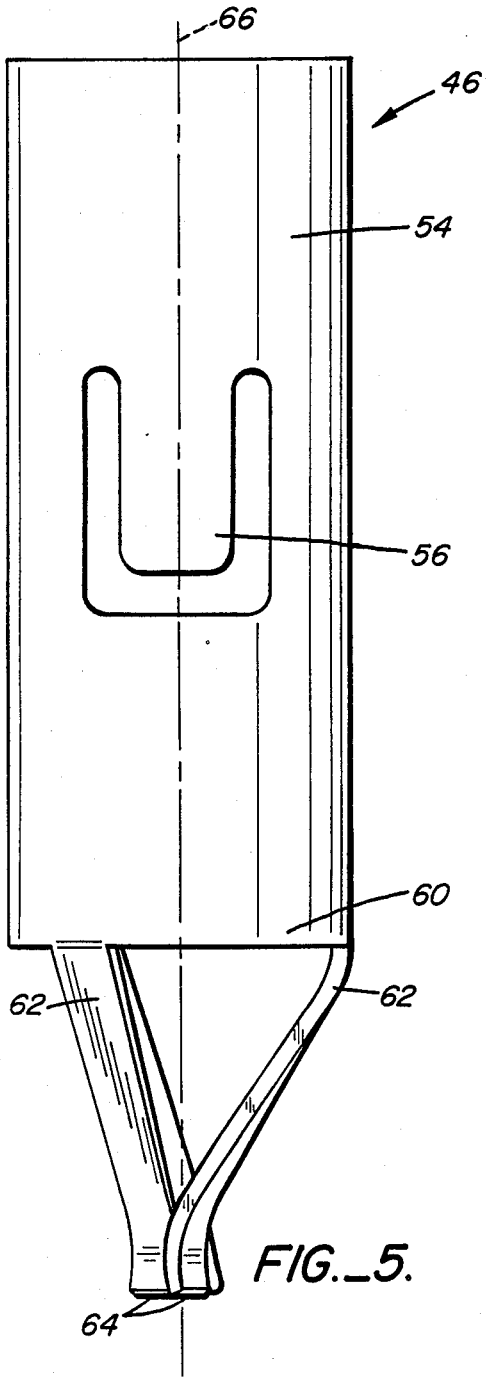
FIG. 5 is a side view of a portion of the modular connector of FIGS. 3 and 4.
Figure 6:
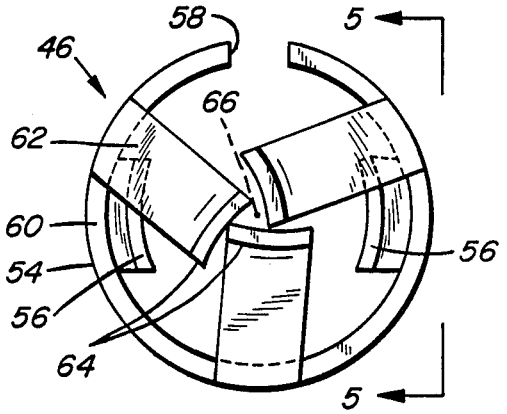
FIG. 6 is an end view of the modular connector portion shown in FIG. 5.

FIGS. 3–8 show a modular connector 40 of the invention. The modular connector 40 includes a housing 42 having a rubber grommet 43 through which pins 12 crimped to wires 48 pass to plug into sockets 46. The housing 42 is formed from two pieces 45 and 47 and is molded from a polyester, with an array 50 of receptacles 52 for the sockets 46. The sockets 46 have a cylindrical beryllium copper alloy body 54 with cantilever spring elements 56 positioned at 180 degrees with respect to each other on the body 54. A slot 58 extends the length of the body 54, positioned at 90 degrees relative the spring elements 56. The body 54 has a distal end 60 with three fingers 62 extending from the distal end 60. As is best shown in FIGS. 5 and 6, the three fingers 62 are positioned on the body 54 at 120 degrees with respect to one another and so that they are radially displaced with respect to the cantilever spring elements 56. The fingers 62 have arcuate tips 64 and incline from the distal end 60 of the body 54 so that the tips 64 are contiguous to axis 66 of the body 54 when pins 12 are not plugged into the sockets 46. The fingers 62 are formed so that the tips 64 are offset as is best seen in FIG. 6, so that they do not have surfaces which touch over a substantial area. As a result, the tips 64 can be plated with a noble metal after the sockets 46 are formed.

Because the sockets 46 have the fingers 62 extending directly from the body 54, the sockets 46 are substantially shorter than the prior art socket 14. This reduced socket length helps to produce a shorter conduction path in the connector 40, a consideration that is important in data processing and other applications where signal transmission speed is essential. The provision of the cantilever spring element contacts 56 and the contact fingers 62 in five different axes provides contact redundancy in the connector 40. This configuration has an increased likelihood of making contact on a dirty pin compared with prior art configurations.

In practice, the sockets 46 are fabricated from flat metal stock by stamping a shape that will form the body 54, spring elements 56 and fingers 62. The stamped metal stock is then deformed around a mandrel to produce the cylindrical body 54 with the spring elements 56 and fingers 62 extending from it.

Figure 7:
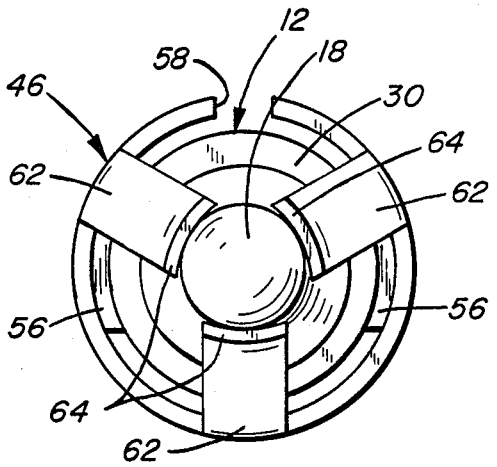
FIG. 7 is another end view of the modular connector portion of FIG. 6, but in another position during its use.

When the pins 12 are inserted in the sockets 46, rings 30 on the base portions 16 of the pins 12 snap behind the spring elements 56 in the same manner as with the spring elements 26 in the connector 10 to lock the pins 12 into place in the sockets 14 with the spring elements 26 making contact with the base portions 16 of the pins 12. Distal portions 18 of the pins 12 spread the tips 64 of the fingers 62 to make contact between the fingers 62 and the pins 12. FIG. 7 shows the fingers 62 after the pin 12 has been inserted in them. By comparing FIG. 7 with FIG. 6, it can be seen that the offset tips 64 in FIG. 6 have moved laterally as well as outwardly in response to the pin 12, so that both longitudinal and lateral contact wiping takes place between the tips 64 and the pin 12 to insure good electrical contact between them. The pin 12 is inserted and removed from the fingers 62 by means of a standard M 81969 type insertion and removal tool. Note that the standard MIL-C-39029/4 type pin 12 is usable with the connector 40. With the radial displacement of the spring elements 56 and the fingers 62, current flowing between the pins 12 and the sockets 46 is evenly spaced around the circumference of both elements. As a result, the connector 40 has a substantially greater current capacity at a given voltage drop than the connector 10. Alternatively, with the same current load, the connector 40 has a substantially lower voltage drop than the connector 10. The radial displacement of the spring elements 56 and the fingers 62 also provides increased insensitivity to vibration and shock, because the contact points between the sockets 46 and the pins 12 are affected differently by the motion of vibration and shock. Increased reliability is obtained with more contact points in this design.

Figures 8, 9:
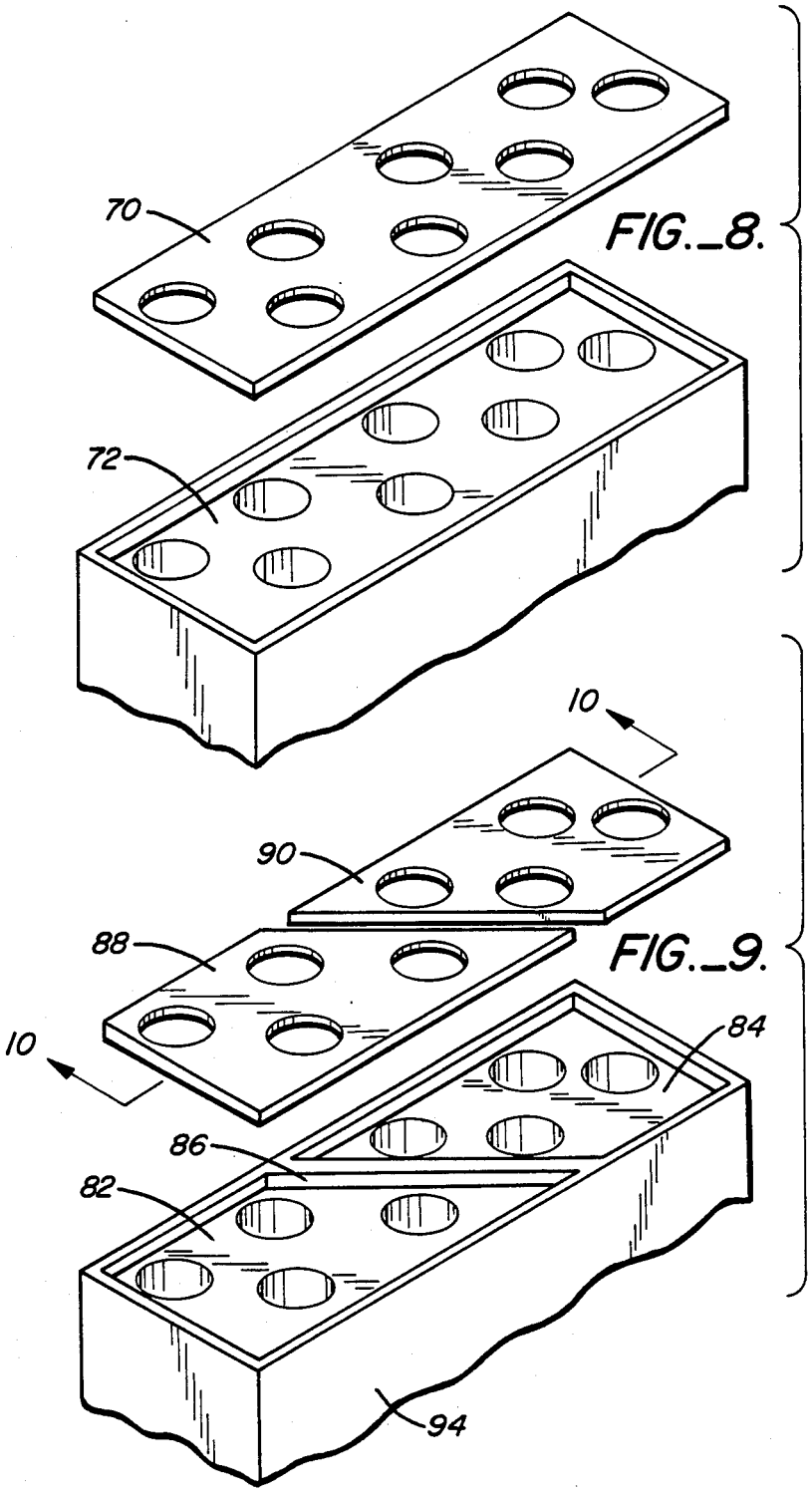
FIG. 8 is an exploded perspective view of a portion of the modular connector of FIGS. 3–7.
FIG. 9 is another exploded perspective view of a corresponding portion of another embodiment of a modular connector in accordance with the invention.

Body 54 of each socket 46 engages a common bus element 70 (FIG. 4). As shown in FIGS. 4 and 8, an enclosed chamber 72 between the top 45 and bottom 47 of the housing 42 receives the bus element 70. The top 45 and bottom 47 are ultrasonically bonded together to form the enclosed chamber 72. This construction eliminates the prior art use of an epoxy potting compound to seal the bus element. In the prior art connector, the bus element is located at the bottom of the pins 12. Locating the bus element to engage body 54 of the sockets 46, together with the design of the sockets 46 as explained above, reduces the length of the conduction path in the connector 40. The bus element 70 is connected to ground or other potential level through one of the wires 48.

Figure 10:
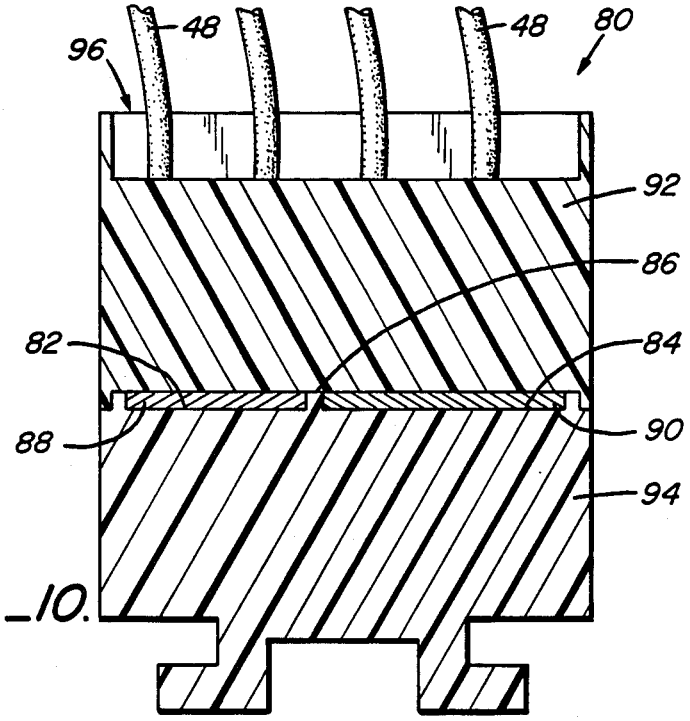
FIG. 10 is a cross-section view of the assembled modular connector embodiment of FIG. 9.
Figure 11:
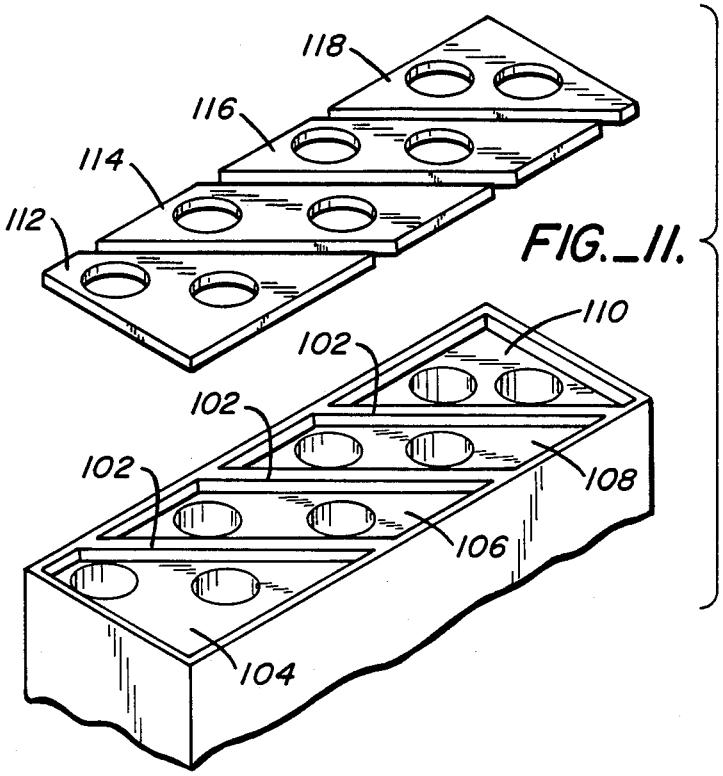
FIG. 11 is an exploded perspective view of a corresponding portion as in FIGS. 8 and 9 of still another embodiment of a modular connector in accordance with the invention.

FIGS. 9 and 10 show another connector 80, the construction of which is the same as the connector 40, except that there are two enclosed chambers 82 and 84, separated by a partition 86, and separate bus elements 88 and 90 in each of the chambers 82 and 84. In addition to sealing around their periphery when top 92 and bottom 94 of housing 96 are ultrasonically bonded together, sealing takes place along partition 86. The connector 80 thus provides two separate groups of four commoned sockets 46. FIG. 11 shows a bottom 100 of another connector, which is the same as the connector 80 in construction, except that three partitions 102 extend diagonally across the bottom 100 to form four chambers 104, 106, 108 and 110. Four separate bus elements 112, 114, 116 and 118 are used with the bottom 100 to provide four separate groups each of two commoned sockets.

It should now be readily apparent to those skilled in the art that a novel connector capable of achieving the stated objects of the invention has been provided. The connector has a substantially increased current capacity and insensitivity to shock and vibration as a result of having contact elements of a socket radially displaced relative to one another, so that current flow is evenly spaced around a pin inserted in the socket. Contact wipe between the pins and sockets is obtained in two axes. Fabrication of the connector is simplified by allowing plating to be carried out in a single step after the socket is formed. Standard pin contacts and pin insertion/-removal tools can be used with the connector. Bus elements in the connector are isolatable without requiring the use of potting compounds. These results are achieved while maintaining a standard form factor for the connector.

It should further be apparent to those skilled in the art that various changes in form and details of the invention as shown and described may be made. It is intended that such changes be included within the spirit and scope of the claims appended hereto.

What is claimed is:

1. A connector, which comprises a housing, an array of socket receptacles in said housing, a plurality of conductive sockets, one of each of said plurality of conductive sockets being positioned in one of the socket receptacles in said array, said plurality of conductive sockets each having a generally cylindrical wall, at least one cantilever spring contact element extending inward from the generally cylindrical wall into each of said plurality of conductive sockets and a plurality of contact fingers extending from a distal end of the generally cylindrical wall at an angle toward a longitudinal axis of the generally cylindrical wall, the at least one cantilever spring contact element and the plurality of contact fingers being radially displaced with respect to one another, the plurality of contact fingers having tips positioned offset from one another, so that both longitudinal and lateral contact wiping takes place upon insertion of a contact pin into each of said plurality of sockets.

2. The connector of claim 1 additionally comprising a plurality of mating conductive pins, one of each being engaged by one of said plurality of conductive sockets, each of said plurality of mating conductive pins having a base portion and a distal portion, the base portion being in electrical contact with the at least one cantilever spring contact and the distal portion being in electrical contact with the plurality of contact fingers.

3. The connector of claim 2 in which said plurality of mating conductive pins has a ring member on the base portion positioned to fit in locking engagement behind the at least one cantilever spring contact of said plurality of conductive sockets when each of said plurality of conductive pins is inserted in each of said plurality of conductive sockets.

4. The connector of claim 1 in which the generally cylindrical wall, at least one cantilever spring contact and the plurality of fingers are formed from a single body of metal.

5. The connector of claim 1 in which said plurality of sockets are recessed in said housing and said connector includes a resilient grommet positioned on said housing over said plurality of sockets, said resilient grommet including a plurality of apertures passing through said resilient grommet, each one of said plurality of apertures being aligned with one of said plurality of sockets.

6. A connector, which comprises a housing, an array of socket receptacles in said housing, a plurality of conductive sockets, one of each of said plurality of conductive sockets being positioned in one of the socket receptacles in said array, said plurality of conductive sockets each having a generally cylindrical wall, at least one cantilever spring contact element extending inward from the generally cylindrical wall into each of said plurality of conductive sockets and a plurality of contact fingers extending from a distal end of the generally cylindrical wall at an angle toward a longitudinal axis of the generally cylindrical wall, the at least one cantilever spring contact element and the plurality of contact fingers being radially displaced with respect to one another, said housing comprising a top portion and a bottom portion attached together to define at least one enclosure between the top portion and the bottom portion, the connector further including at least one bus element in the enclosure connected to at least some of said plurality of conductive sockets.

7. The connector of claim 6 in which said at least one bus element- is connected to the cylindrical wall of at least some of said plurality of conductive sockets.

8. The connector of claim 6 in which there is at least one partition extending between the top portion and the bottom portion of said housing to define a plurality of the enclosures, and there is a separate bus element in each of the plurality of enclosures.

9. A connector, which comprises a housing, at least one socket receptacle in said housing, a conductive socket positioned in said socket receptacle, said conductive socket having a generally cylindrical wall, at least one cantilever spring contact element extending inward from the generally cylindrical wall into said conductive socket and a plurality of contact fingers extending from a distal end of the generally cylindrical wall at an angle toward a longitudinal axis of the generally cylindrical wall, the at least one cantilever spring contact element and the plurality of contact fingers being radially displaced with respect to one another, the plurality of contact fingers having tips positioned offset from one another, so that both longitudinal and lateral contact wiping takes place upon insertion of a contact pin into said conductive socket.

10. The connector of claim 9 additionally comprising a mating conductive pin engaged by said conductive socket, said mating conductive pin having a base portion and a distal portion, the base portion being in electrical contact with the at least one cantilever spring contact and the distal portion being in electrical contact with the plurality of contact fingers.

11. The connector of claim 10 in which said mating conductive pin has a ring member on the base portion positioned to fit in locking engagement behind the at least one cantilever spring contact of said conductive socket when said conductive pin is inserted in said conductive socket.

12. The connector of claim 9 in which the generally cylindrical wall, at least one cantilever spring contact and the plurality of fingers are formed from a single body of metal.

13. The connector of claim 9 in which said socket is recessed in said housing and said connector includes a resilient grommet positioned on said housing over said socket, said resilient grommet including an aperture passing through said resilient grommet and aligned with said socket.

* * * * *